US005126714A

United States Patent [19]

Johnson

[11] Patent Number: 5,126,714

[45] Date of Patent: Jun. 30, 1992

[54] INTEGRATED CIRCUIT TRANSFORMER

[75] Inventor: Leopold J. Johnson, Valley Center, Calif.

[73] Assignee: The United States of America as represented by the Secretary of the Navy, Washington, D.C.

[21] Appl. No.: 633,550

[22] Filed: Dec. 20, 1990

[51] Int. Cl.[5] ..... H01F 27/24; H01F 27/30

[52] U.S. Cl. ..... 336/83; 336/183; 336/200; 336/223; 336/232

[58] Field of Search ..... 336/83, 182, 183, 200, 336/232, 223, 225, 192, 212, 233, 215, 218

[56] References Cited

U.S. PATENT DOCUMENTS

| | | | |
|---|---|---|---|
| 3,058,078 | 10/1962 | Hoh | 336/232 |
| 3,098,181 | 7/1963 | Cioffi | 335/216 |
| 3,184,674 | 5/1965 | Garwin | 335/216 X |
| 3,214,679 | 10/1965 | Richards | 323/360 |
| 3,271,658 | 9/1966 | Cheng | 307/306 |
| 3,275,843 | 9/1966 | Meyerhoff | 307/306 |
| 3,319,206 | 5/1967 | Harloff | 336/218 |
| 3,833,872 | 9/1974 | Marcus et al. | 336/232 |
| 4,376,274 | 3/1983 | Smart | 336/232 |
| 4,451,812 | 5/1984 | Vescovi et al. | 336/232 |
| 4,538,132 | 8/1985 | Hiyama et al. | 336/232 |
| 4,547,961 | 10/1985 | Bokil et al. | 336/200 |
| 4,591,814 | 5/1986 | Ito et al. | 336/200 |
| 4,641,114 | 2/1987 | Person | 336/232 |
| 4,785,345 | 11/1988 | Rawls et al. | 336/232 |
| 4,800,356 | 1/1989 | Ellis | 336/212 X |
| 4,803,453 | 2/1989 | Tomono et al. | 336/183 |

*Primary Examiner*—Thomas J. Kozma

*Attorney, Agent, or Firm*—Harvey Fendelman; Thomas Glenn Keough

[57] ABSTRACT

An integrated circuit transformer (58) which is constructed in a laminar fashion is disclosed. The present invention includes a bottom plate (10) with cores (14) protruding from its upper surface (13) and a top plate (16) with several feed through holes (18). Both plates (10, 16) are made from high permeability magnetic material. Interposed between the top and bottom plates (10, 16) are at least one primary (19) and at least one secondary (40). The primary (19) has feed through holes (22), vertically aligned with the feed through holes (18) in the top (16), holes (20) to allow the cores (14) to protrude through, and tabs (26, 28) for connecting to the input circuit. The primary (19) is made of a laminate clad with an electrical conductor. The circuit which conducts the current around the cores is fabricated by etching special patterns of insulative gaps (24) into the electrical conductor. The secondary (40) has holes (42) to allow the cores (14) to protrude through. It also is made of a laminate clad with an electrical conductor. And again, the circuit which conducts the current around the cores is fabricated by etching a special pattern of insulative gaps (44) into the electrical conductor. The output circuit is connected to the secondary at three connection points (48, 50, 52). These points are accessible through the feed through holes (18, 22) and access holes (49, 51). The primary (19) and secondary (40) may be fabricated as a sub-assembly by multiple layer printed circuit techniques. More than one primary (19) and secondary (40) may be utilized in the integrated transformer (58). The transformer may be embodied as either a current, a voltage or a power transformer.

10 Claims, 6 Drawing Sheets

INTEGRATED CIRCUIT TRANSFORMER

STATEMENT OF GOVERNMENT INTEREST

The invention described herein may be manufactured and used by or for the Government of the United States of America for governmental purposes without the payment of royalties thereon or therefor.

BACKGROUND OF THE INVENTION

The present invention relates to the field of transformer fabrication. More particularly, it relates to transformers made by printed circuit board techniques.

Transformers are devices that increase or decrease the voltage of alternating current. They are usually fabricated by winding several coils of wire around a large magnetic core. Cores may be cylindrical but typically, toroidal core are used. One coil, called the primary, is connected to the input circuit, whose voltage is to be changed. The other coil, called the secondary, is connected to the output circuit, which is where the electricity with the changed (transformed) voltage is used.

As the alternating current in the input circuit travels through the primary, it sets up a magnetic field that changes in intensity and direction in response to the alternating current. The changing magnetic flux induces an alternating voltage in the secondary. The ratio of the number of turns in each coil determines the transformation ratio. For example, if there are twice as many turns in the primary as in the secondary, the output voltage will be half that of the input voltage. On the other hand, since energy cannot be created or destroyed, the output current will be twice as much as the input current.

Since coil winding is a long and tedious process, commercial transformer design is primarily driven by cost. In other words, manufacturers try to minimize core size and coil length. However, there is a practical limit to decreasing the size of transformers and the smallest transformers, which would be desirable for high frequency applications, are very expensive to produce. The reduction in size usually reduces cost through the lesser amount of material needed to build them but this cost of materials, usually assumed to be a major portion of total cost, is a lesser factor as size goes below a practical limit. Continued reduction in size increases cost of assembly exponentially as size continues to get smaller until, at some minimum size, a smaller size cannot be produced. The result is that commercially available transformers are only 90 to 95 percent efficient.

If a way could be found to fabricate transformers that did not require coil winding, that was inexpensive, and that produced small transformers, with higher efficiency, it would satisfy a long felt need in the field of transformer fabrication. This breakthrough would facilitate use of transformers in high frequency applications.

SUMMARY OF THE INVENTION

The integrated circuit transformer is made by printed circuit techniques rather than by coil winding techniques. Thus it is cheaper to produce, can be made faster, has increased efficiency and can be used in higher frequency applications. The integrated circuit transformer is constructed in a laminar fashion. Its backbone is a bottom plate with cores protruding from its upper surface and a top plate with several feed through holes.

Both plates are made from high permeability magnetic material. When the top plate is assembled on top of the core sections protruding from the bottom plate they create high permeability paths for magnetic flux.

Interposed between the top and bottom plates are at least one primary and at least one secondary. The primary and secondary have feed through holes, vertically aligned with the feed through holes in the top holes to allow the secondary terminals to protrude through, and tabs for connecting to the input circuit. The primary is made of a laminate clad with an electrical conductor. The current flows in the electrical conductor. The circuit which conducts the current around the many core sections is fabricated by etching a special pattern of insulative gaps into the electrical conductor. The gaps are necessary to prevent shorting but they must be quite narrow in order to minimize leakage of magnetic flux. If more than one primary layer is used the primary layers are connected to each other in series. Furthermore, they are connected so the path taken by the electrical current in one layer is opposite to that taken by the current in the previous primary layer in the series.

The printed circuit windings have holes to allow the core sections to protrude through. The circuit which conducts the current around the cores is fabricated by etching a special pattern of insulative gaps into the electrical conductor. The gaps are necessary to prevent shorting but they must be quite narrow in order to minimize leakage of magnetic flux. The output circuit is connected to the secondary at three points. These points are accessible through the feed through holes which pierce the top and the primary. If more than one secondary is used, the patterns etched into their surfaces are rotated from each other by 90 degrees. A center-tapped transformer can be provided by connecting the secondary layers to each other at the center connection point.

The completed transformer is laminar in construction. In fact the primary and secondary can be fabricated by single or multiple layer printed circuit techniques. This makes them very inexpensive to produce and repeatably, precisely manufacturable. The completed transformer also has a low profile, small volume and is very efficient, transforming high power currents with very low impedance. The breakthrough provided by this invention facilitates use of transformers in high frequency applications.

An appreciation of other aims and objectives of the present invention and a more complete and comprehensive understanding of this invention may be achieved by studying the following description of a preferred embodiment and by referring to the accompanying drawings.

DETAILED DESCRIPTION OF THE PREFERRED EMBODIMENT

Figure 1A:
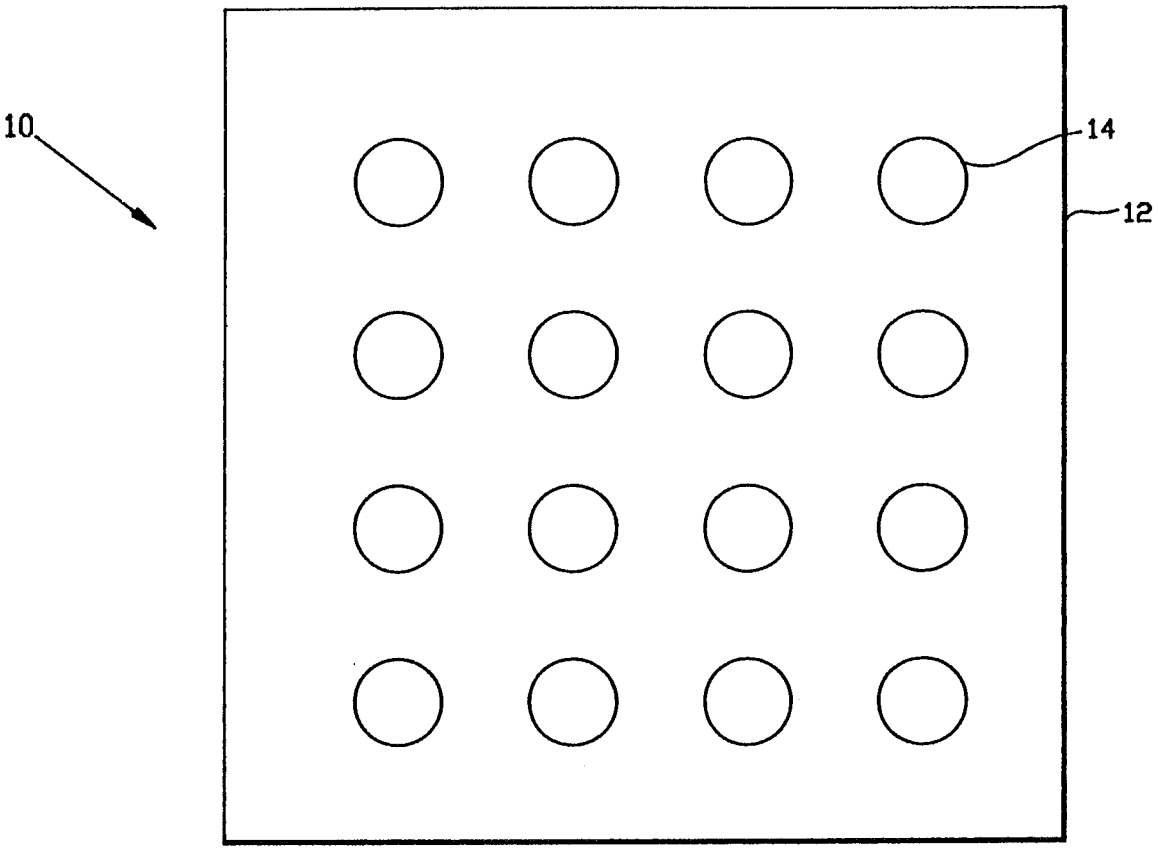
FIG. 1A is a plan view of a typical magnetic core base.
Figure 1B:
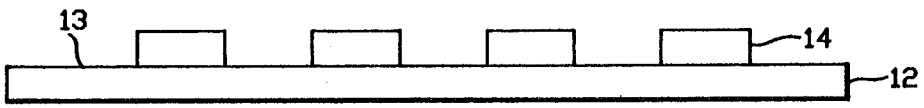
FIG. 1B is a side view of the typical base.

A typical base 10 of the present invention is shown via a plan view in FIG. 1A and via a side view in FIG. 1B. The base 10 consists of a bottom plate 12 which has a number of core sections 14 projecting in a regular pattern from its upper surface 13. The base 10 can be any shape—circular, rhomboid, or trapezoid—but a square base 10 is shown for illustrative purposes. The core sections 14 can be any shape but cylindrical cores 14 have been chosen for illustrative purposes. The transformer can work if there are only two core sections 14 but any even number can be used. For purposes of illustration the number of core section 14 shown in FIG. 1 is sixteen. The core sections 14 can be placed at any desired location on the bottom plate 12 but obviously, the base 10 is easier to fabricate if the core sections 14 are placed in a regular pattern on the bottom plate 12. The base 10 is fabricated from a high permeability magnetic material. In the preferred embodiment, Ferrite is used. The base 10 can be fabricated by machining from a block or joining the core sections 14 to the bottom plate 12.

Figure 2:
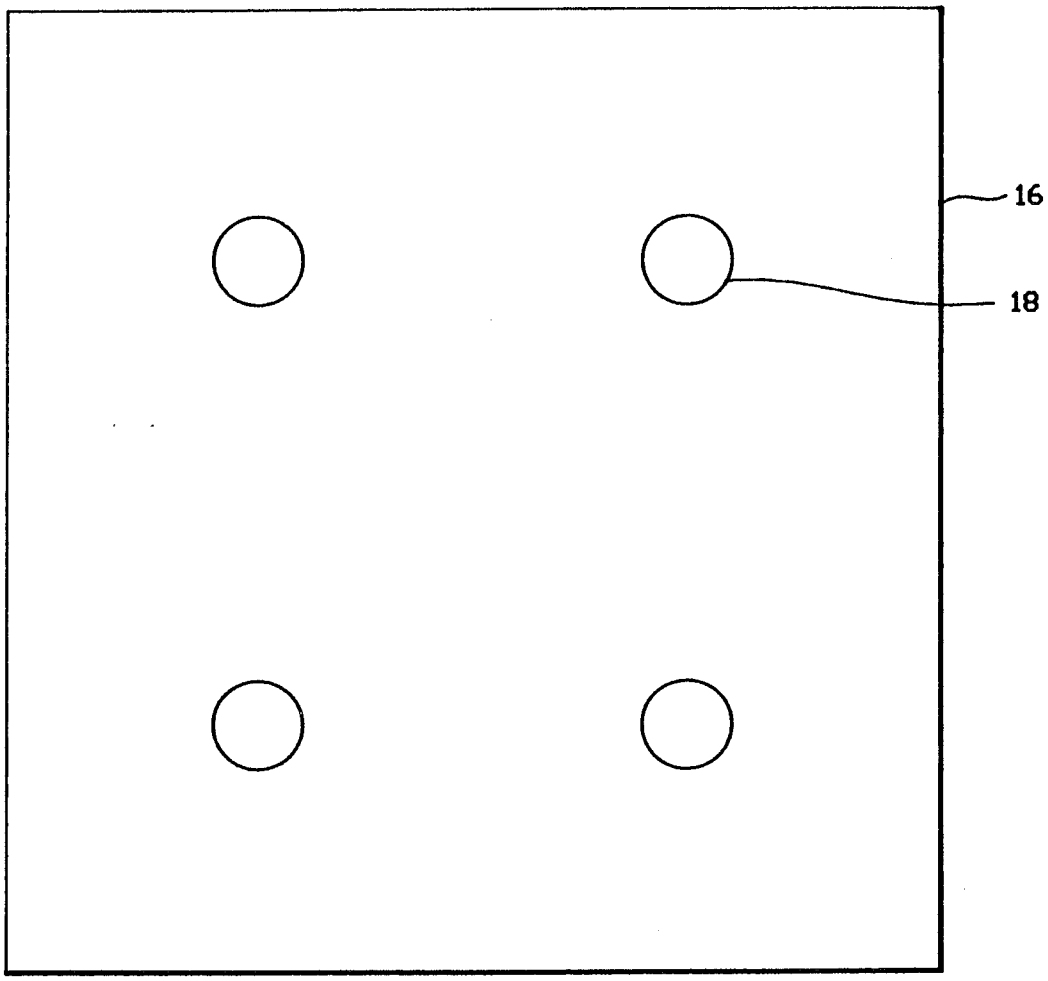
FIG. 2 is a plan view of a typical magnetic core top.

FIG. 2 shows construction of the top 16. The top 16 is a plate of the same size and shape as the base 10 with a pattern of feed through holes 18 machined through it. In this illustration, there are four feed through holes 18. In this case, when the top 16 is assembled over the base 10, the feed through holes line up in the middle of each quadrant of four core sections 14. However, the number and locations of the feed through holes can be varied as desired to suit the design purposes. The top 16 is also fabricated from a high permeability magnetic material. Again, in the preferred embodiment Ferrite is used.

Figure 3:
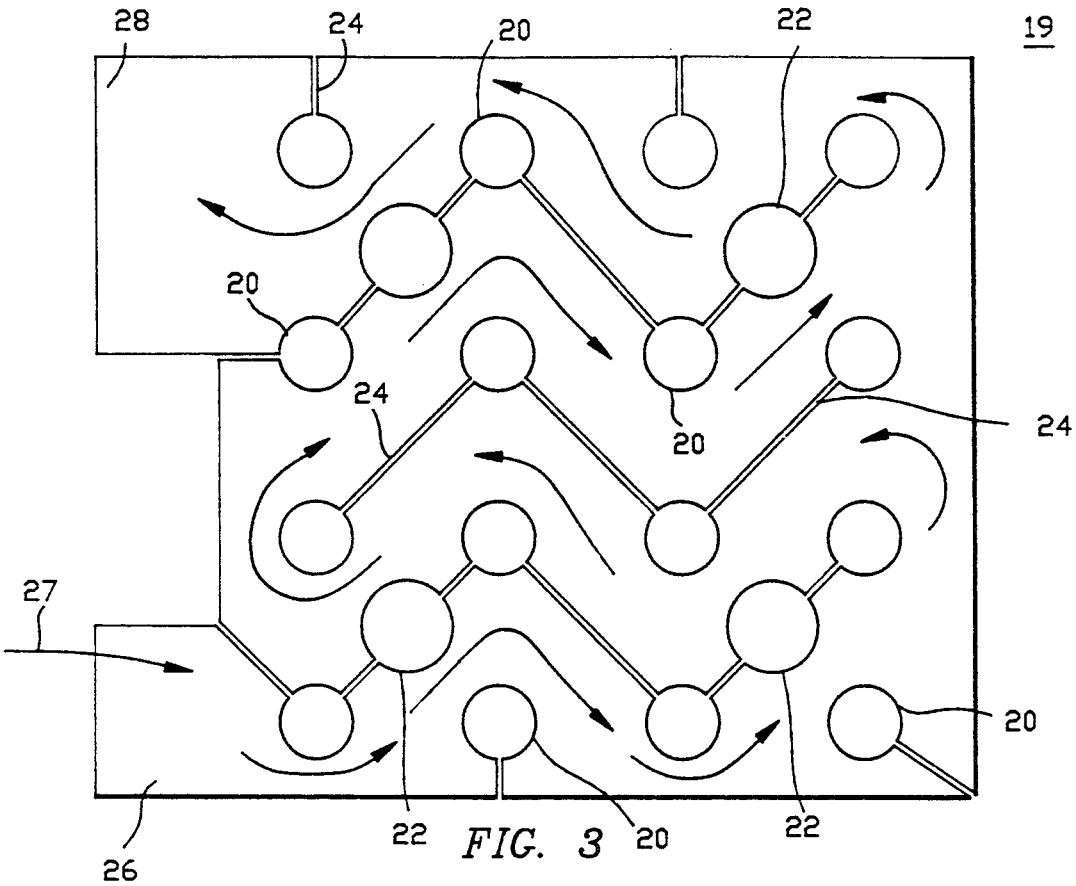
FIG. 3 is a plan view of a typical first primary layer showing the pattern etched into the copper cladding.

FIG. 3 shows, for illustrative purposes, a plan view of a primary layer 19 which is to be used with the core 10 and top 16 shown in FIGS. 1 and 2. In the preferred embodiment, the primary 19 is a copper clad laminate with insulative gaps 24 cut into the cladding by well known printed wiring board fabrication techniques. The gaps 24 are necessary to prevent shorting but they must be quite narrow in order to minimize leakage of magnetic flux. For optimum operation, the maximum amount of copper cladding is left. The primary 19 also has core holes 20 and feed through holes 22 machined through it. When the primary 19 is assembled between the base 10 and top 16 the core holes 20 allow for projection of the core sections 14 through the primary 19 and the feed through holes 22 line up with the feed through holes 18 of the top 16. The primary 19 is essentially the same size as the base 10 and the top 16 except for a current input tab 26 and an current output tab 28. When the tabs 26, 28 are connected to an input circuit, the current is directed by the insulative gaps 24 in a circulating pattern around the cores 14. This current flow is indicated by the arrows 27 on FIG. 3.

Figure 4:
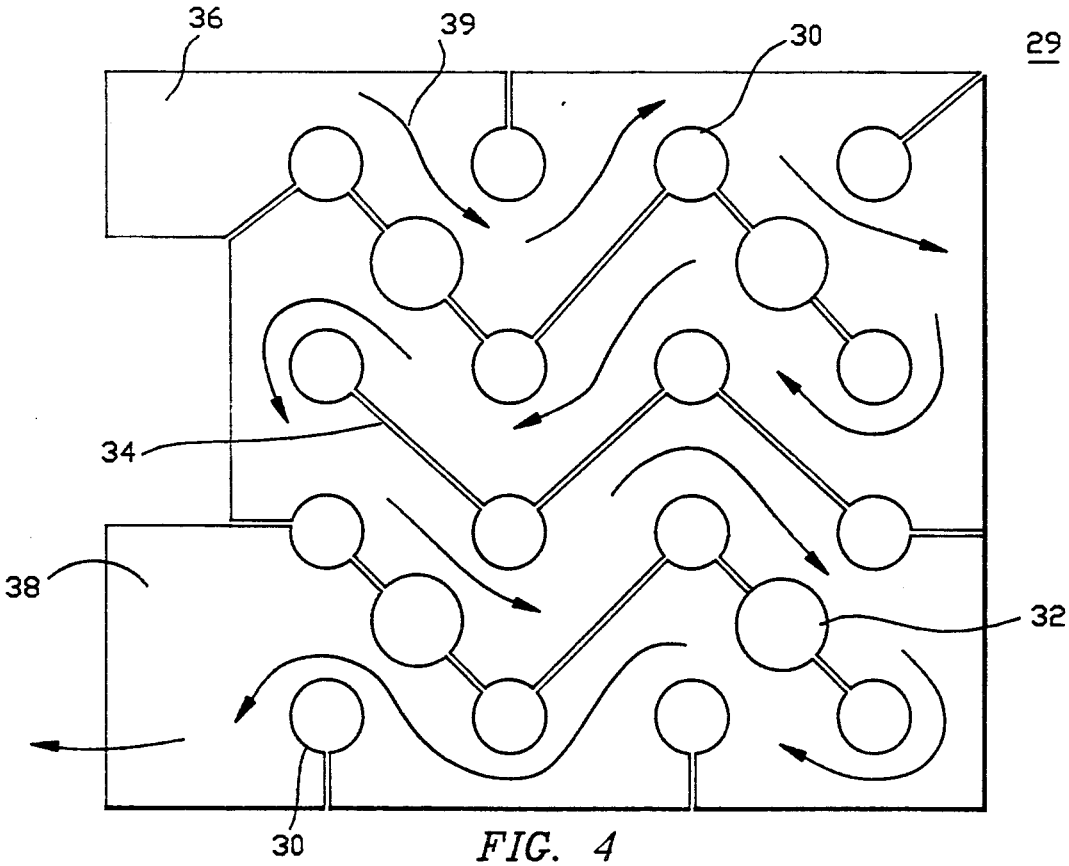
FIG. 4 is a plan view of a typical second primary showing the pattern etched into the copper cladding.

FIG. 4 shows, for illustrative purposes, a plan view of an optional second primary layer 29. In the preferred embodiment, the second primary layer 29 is a copper clad laminate with insulative gaps 34 cut into the cladding by well known printed wiring board fabrication techniques. The gaps 34 are necessary to prevent shorting but they must be quite narrow in order to minimize leakage of magnetic flux. For optimum operation, the maximum amount of copper cladding is left. The second primary layer 29 also has core holes 30 and feed through holes 32 machined through it. When the second primary layer 29 is assembled between the base 10 and top 16 the core holes 30 allow for projection of the core sections 14 through the second primary layer 29 and the feed through holes 32 line up with the feed through holes 18 of the top 16.

The second primary layer 29 is essentially the same size as the base 10 and the top 16 except for a current input tab 36 and a current output tab 38. If it is desired to use a second primary layer 29, the current input tab 36 is electrically connected to the current output tab 28 of the first primary layer 19. Then the input circuit is connected to the current input tab 27 of the first primary layer 19 and the current output tab 38 of the second primary layer 29. When connected in this manner, the current in the second primary layer 29 is directed by the insulative gaps 34 in a circulating pattern around the core sections 14. This current flow is indicated by the arrows 39 on FIG. 4. It should be noted that the current flow in the second primary layer 29 is in a direction opposite to that in the first primary layer 19. The second primary layer 29 shown on FIG. 4 is identical to the first primary layer 19 except that its pattern is reversed. This is done to make connection of the tabs 27 and 38 easy and to ensure that the current flows are opposite to each other in each layer 19, 29. More primary layers 19 and 29 can be added to the transformer provided they are connected in series as described above and the current flow in each layer 19 or 29 is opposite to that in the previous layer 19 or 29.

Figure 5:
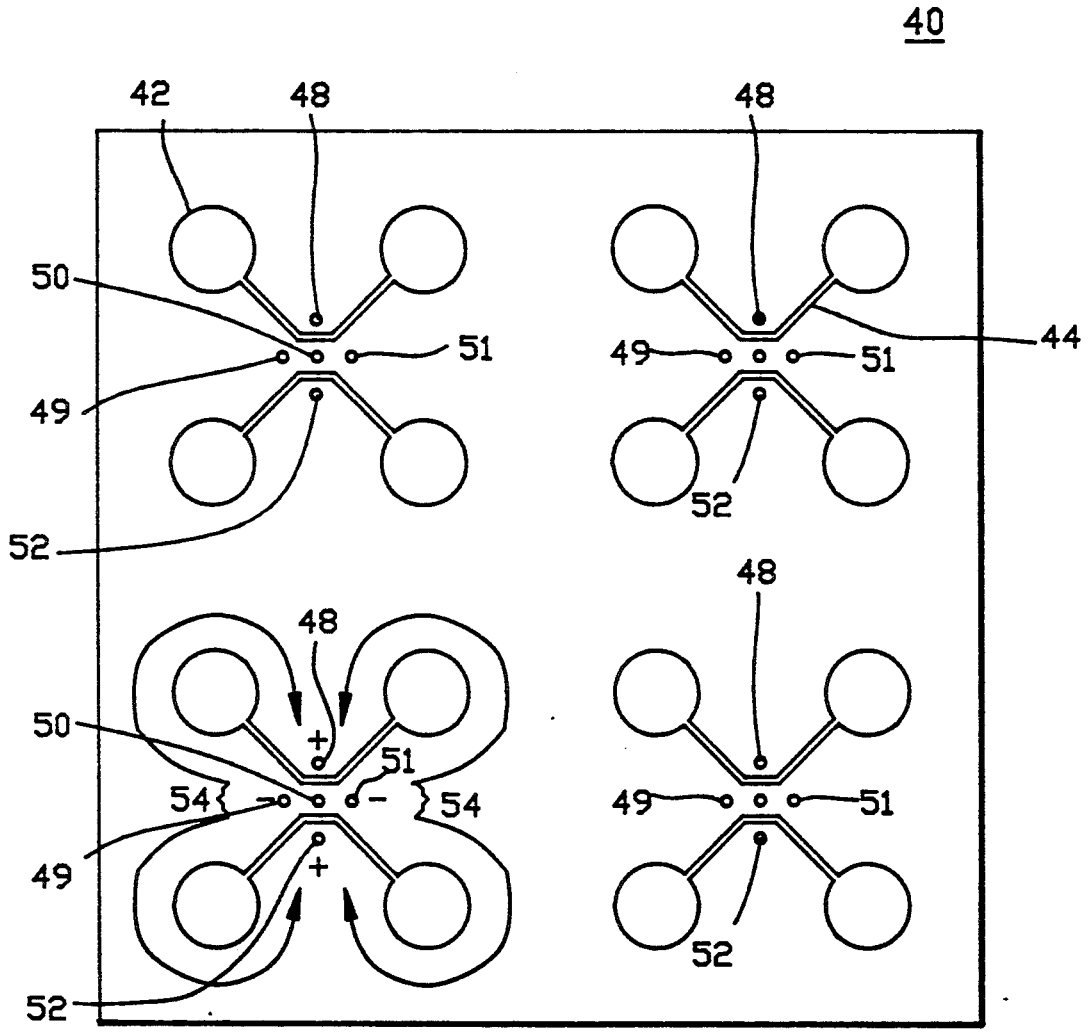
FIG. 5 is a plan view of several typical secondary sections showing the patterns etched into the copper cladding.

FIG. 5 shows, for illustrative purposes, a plan view of the secondary 40 intended for use with the base 10 of FIG. 1. In the preferred embodiment, the secondary 40 is again a copper clad laminate. Each quadrant of the secondary 40 shown on FIG. 5 forms a separate transformer. Each quadrant of the secondary 40 has four core holes 42 machined through it and special insulative gaps 44 etched into the cladding by well known printed wiring board fabrication techniques. The gaps 44 are designed to define the current paths. The gaps 44 are necessary to prevent shorting but they must be quite narrow in order to minimize leakage of magnetic flux. For optimum operation, the maximum amount of copper cladding is left.

In the center of each quadrant are three contact points 48, 50, 52. These contact points 48, 50, 52 can be pins connected to the copper cladding, plated through holes or any convenient devices which will allow for electrical connection of the secondary 40 to an outside circuit. Additionally, there are two clearance holes 49, 51 which may be used to allow contact points 48,52 to be accessed from other secondary printed circuit layers 40 with a 90 degree rotation of the secondary layer 40. When assembled between the base 10 and the top 16, the core sections 14 project through the cores holes 42 in the secondary. The secondary 40 is designed to produce a special current flow around the core sections in each quadrant. This current flow is indicated by the arrows 54 on FIG. 5. The contact points 48 and 52 are connected to one side of the output circuit and the contact point 50 is connected to the other side of the output circuit. The contact points 48, 50, 52 are accessible through the feed through holes 18, in the top 16, the holes 22 in the first primary layer 19 and, the holes 32 in the second primary 29, if the second primary layer 29 is used. If multiple secondaries 40,40*a* are used, the pattern of each are rotated 90 degrees. It is then possible, by connecting the points 50 in each layer 40, to provide a center tapped transformer configuration.

Figure 6:
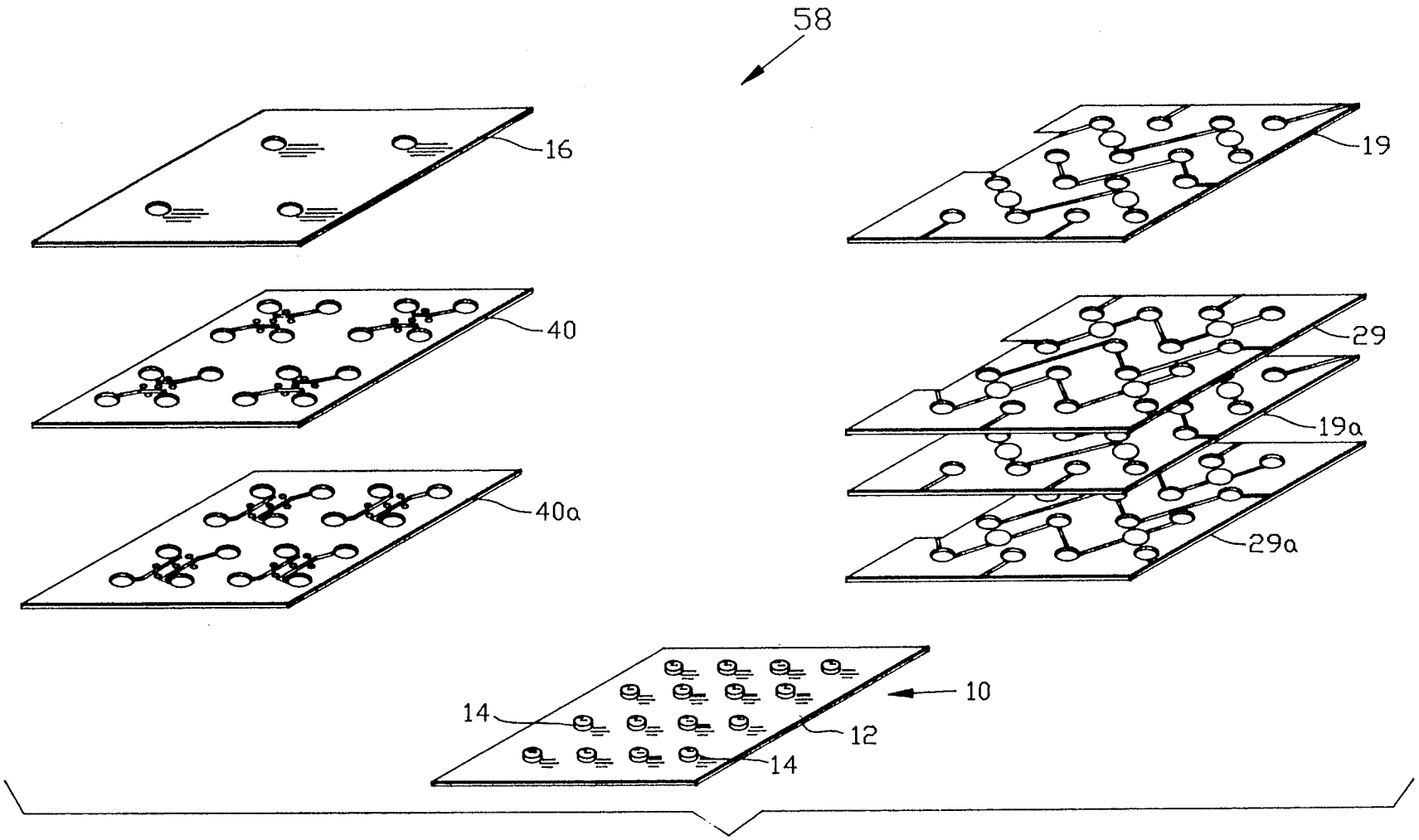
FIG. 6 is an exploded view of one design of an integrated circuit transformer.

FIG. 6 shows, in exploded fashion, one way of assembling a transformer 58 in accordance with this invention. FIG. 6 shows a base 10, one first primary 19, one second primary 29, one first secondary 40, a second secondary 40*a* (the same as 40 but rotated 90 degrees with respect to 40) and one top 16. These layers 10, 19, 29, 40, and 16 are assembled in vertical alignment. This allows the core sections 14 to project through the primaries 19, 29 and the secondaries 40, 40*a* to contact the top 16. When assembled, the base 10 with the core sections and the top 16 create a path for magnetic flux. The exact order of vertical assembly of the layers 19, 29, 40 and 40*a* is not critical but placement of the secondaries 40, 40*a* between the primaries 19, 29 is preferred and the tabs 26, 28, 36, 38 must project on the same side. Multiples of the layers 19, 29, 40 and 40*a* can be utilized.

After assembly, the tabs 28, 36 are electrically connected in order to complete the electrical connection of the two primary layers 19, 29. If more than one primary 19, 29 is utilized then these can also be connected in series. For simplicity, the electrical connections are not shown on FIG. 6. The connection points 48, 50, 52, which are not shown on FIG. 6, are accessible through the feed through holes 18 of the top 16 and point access holes 49, 51 of the secondary layers 40, 40*a*, and, depending on the exact vertical assembly, feed through holes 22, 32.

For operation of the illustrative transformer shown in FIG. 6, the input circuit is connected to the current-/voltage input tab 26 and the current/voltage output tab 38. The input current flows around the core sections 14 in a continuous path in the first primary 19 as shown by the arrows 27 on FIG. 3. The insulative gaps 34 determine this current path. The input current then flows around the core sections 14 in an opposite sinusoidal direction in the second primary 29 as shown by the arrows 39 on FIG. 4. The insulative gaps 34 create this current path. The current flow in the primaries 19, 29 is similar to that of a coil of wire in a wire wound transformer. The current flow sets up a magnetic field that changes in intensity and direction as the current alternates. This changing magnetic flux then induces an alternating current/voltage in the secondary. The special way that the insulative gaps 44 are cut into the secondary create the secondary current/voltage, as shown by the arrow 54 on FIG. 5. The contact points 48 and 52 are connected to one side of the output circuit and the contact point 50 is a center tap of the output circuit while points 48,52 of the rotated secondary 40 are connected to the other side of the output circuit.

Figure 7:
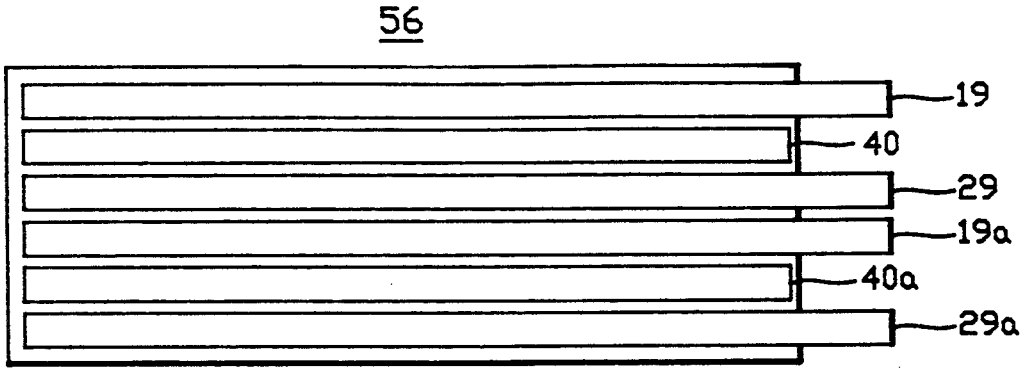
FIG. 7 is a side view of several primary and secondary layers fabricated as a multi-layer printed circuit board.

While the primary 19, 29 and the secondary layers 40 can be fabricated individually by well known printed circuit board techniques, an entire sub-assembly of primaries 19, 29 and secondaries 40,40*a* can be fabricated by well known multi-layer printed circuit board techniques. FIG. 7 shows an example of just one such multi-layer printed circuit board variation 56. This example includes two sets of primaries 19, 19*a*, 29, 29*a* and secondaries 40, 40*a* and a fiberglass/resin matrix 55. For simplicity, the core holes 20, 30, 42, the feed through holes 18, 22, 32 and the electrical connections are not shown. When utilizing the multi-layer printed circuit variation 56, it is only necessary to assemble the printed circuit 56 between the base 10 and the top 16.

Figure 8:
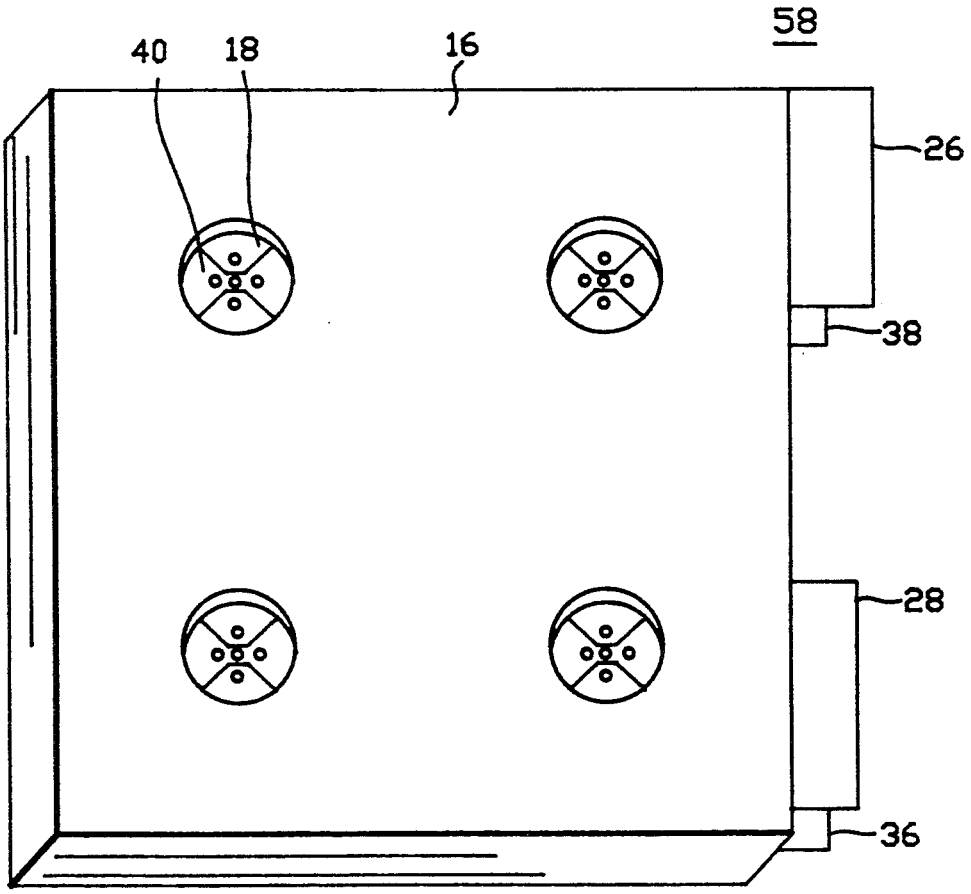
FIG. 8 is a perspective view of a typical, integrated circuit transformer.

FIG. 8 shows what an assembled transformer 58 looks like. From the top 16 portions of the secondary 40 can be seen through the feed through holes 18. The tabs 26, 28, 36 38 project from one side. For simplicity, the contact points 48, 50, 52 and the electrical connections are not shown.

This invention is specially designed to produce circulation of primary and secondary current around magnetic core sections in order to effect current/voltage transformation. However, printed wiring board fabrication techniques are utilized rather than coil winding techniques. This enables the transformers to be made less expensively and more reliably. The suitability for use of the present invention can readily be seen for those applications where, prior to this invention, wire wound transformers would have been used. As compared to a wire wound transformer having one tall core, a single multiple winding primary and a single multiple winding secondary, the integrated circuit transformer has many short core sections, and a primary and secondary that wind around each of these cores in one or a few turns. The great width of conductor in the integrated circuit transformer may be likened to the many windings in a coil made of a thin wire.

Other advantages conferred by this invention are freedom of shape, ease of obtaining desired ratios, ability to create half turns accurately, small volume, low weight, high power and low impedance. This means integrated circuit transformers can be designed to fit in confined spaces, between or around other components, and they can be used in applications up to 20 MHz frequency. Transformers made by this technique have an efficiency of 99.4% at 2 MHz. Transformers made by coil winding techniques typically only have an efficiency of only 90% to 95%.

Furthermore the design of the integrated circuit transformer allows the designer great freedom to design a transformer with various transformation ratios. The design shown on FIG. 6 has a 32:1 transformation ratio. However, it can readily be seen that this ratio can be modified by altering the number of core sections, the number of primary layers and the number of secondary layers and the arrangement of secondary current paths. Also, is to be understood that although the present invention has been described herein as a "current" transformer, within the scope of the present invention, the integrated circuit transformer claimed herein may be likewise be embodied as a voltage transformer and-/or a power transformer.

Persons possessing ordinary skill in the art to which this invention pertains will appreciate that other modifications and enhancements may be made without departing from the spirit and scope of the claims that follow.

LIST OF REFERENCE NUMERALS

FIG. 1—Base
- 10 Base
- 12 Bottom plate
- 13 Upper surface
- 14 Core section FIG. 2—Top
- 16 Top
- 18 Feed through hole FIG. 3—First primary
- 19 First primary

20 Core hole
22 Feed through hole
24 Insulative gap
26 Current input tab
27 Current flow
28 Current output tab FIG. 4—Second primary
29 Second primary
30 Core hole
32 Feed through hole
34 Insulative gap
36 Current input tab
38 Current output tab
39 Current flow FIG. 5—Secondary
40 Secondary
42 Core hole
44 Insulative gap
48 First connection point
49 First contact clearance hole
50 Second connection point
51 Second contact clearance hole
52 Third connection point
54 Current flow FIG. 6—Exploded view of assembly
10 Base
14 Core
16 Top
18 Feed through hole
19 First primary
22 Feed through hole
26 Current input tab
28 Current output tab
29 Second primary
32 Feed through hole
36 Current input tab
38 Current output tab
40 Secondary
**40*a*** Secondary rotated 90 degrees
58 Integrated circuit transformer FIG. 7—Multi-layer printed circuit board variation
19 First primary
**19*a*** First primary
29 Second primary
**29*a*** Second primary
40 Secondary
**40*a*** Secondary
55 Fiberglass/resin matrix
56 Multi-layer circuit board FIG. 8—Completed transformer
16 Top
18 Feed through hole
26 Current input tab
28 Current output tab
36 Current input tab
38 Current output tab
40 Secondary
58 Integrated circuit transformer

What is claimed is:

1. An apparatus comprising:

plate means (12) for providing support; said plate means (12) having an upper surface (13); said plate means (12) being made from a high permeability magnetic material;

core means (14) for providing a path for magnetic flux; said core means (14) being integrally formed on said upper surface (13) of said plate means (12); said core means (14) being made from said high permeability magnetic material;

top means (16) for completing said path for magnetic flux; said top means (16) having a top feed through hole (18); said top means being attached to said core means (14); said top means (16) being made of said high permeability magnetic material;

primary means (19) for conducting an input current around said core means (14); said primary means (19) having a primary feed through hole (22) vertically aligned with said top feed through hole (18); said primary means (19) being made of a laminate clad with an electrical conductor; said primary means (19) being interposed between said plate means (12) and said top means (16);

secondary means (40) for inductively coupling with said primary means (19); said secondary means (40) being made of said laminate clad with said electrical conductor; said secondary means (40) being interposed between said plate means (12) and said top means (16); said secondary means conducting an output current around said core means (14); and connection means (48, 50, 52) for making electrical connection to said secondary means (40); said connection means (48, 50, 52) being accessible through said top feed through hole (18), and said primary feed through hole (22).

2. The apparatus as claimed in claim 1, in which said electrical conductor is a metal.

3. The apparatus as claimed in claim 2, in which said high permeability magnetic material is Ferrite.

4. The apparatus as claimed in claim 1, in which said high permeability magnetic material is Ferrite.

5. An apparatus comprising:

a plate (12); said plate (12) having an upper surface (13); said plate (12) being made from a high permeability magnetic material;

a core (14); said core (14) being integrally formed on said upper surface (13) of said plate (12); said core (14) being made from said high permeability magnetic material;

a top (16); said top (16) having a top feed through hole (18); said top (16) being attached to said core (14); said top (16) being made of said high permeability magnetic material;

a primary (19); said primary (19) having a primary feed through hole (22) vertically aligned with said top feed through hole (18); said primary (19) having a primary core hole (20); said primary (19) having a current input tab (26); said primary (19) having a current output tab (28); said primary (19) being made of a laminate clad with an electrical conductor; said primary (19) being interposed between said plate (12) and said top (16); said core (14) projecting through said primary core hole (20); said primary having an insulative gap (24) in said electrical conductor;

a secondary (40); said secondary (40) having a secondary core hole (42); said secondary (40) being made of said laminate clad with said electrical conductor; said secondary (40) being interposed between said plate (12) and said top (16); said core (14) projecting through said secondary core hole (42); said secondary having an insulative gap (44) in said electrical conductor; and a set of connectors (48, 50, 52); said set of connectors being electrically connected to said secondary (40) said set of connectors (48, 50, 52) being accessible through said top feed through hole (18), and said primary feed through hole (22).

6. The apparatus as claimed in claim 5, in which said electrical conductor is a metal.

7. The apparatus as claimed in claim 6, in which said high permeability magnetic material is Ferrite.

8. The apparatus as claimed in claim 5, in which said high permeability magnetic material is Ferrite.

9. The apparatus as claimed in claim 5, in which said set of connectors (48,50,52) is a set of pins.

10. The apparatus as claimed in claim 7, in which said set of connectors (48,50,52) is a set of pins.

* * * * *